United States Patent [19]

Ury et al.

[11] Patent Number: 5,051,663

[45] Date of Patent: Sep. 24, 1991

[54] ELECTRODELESS LAMP WITH IMPROVED BULB MOUNTING ARRANGEMENT

[75] Inventors: Michael G. Ury, Bethesda; John B. Gunter, Catonsville; Wayne H. Johnson, Rockville; Donald E. Kuechle, Gaithersburg, all of Md.

[73] Assignee: Fusion Systems Corporation, Rockville, Md.

[21] Appl. No.: 498,578

[22] Filed: Mar. 26, 1990

[51] Int. Cl.[5] ..... H05B 41/16

[52] U.S. Cl. ..... 315/248; 313/607

[58] Field of Search ..... 315/248, 39; 313/234, 313/607; 362/362, 370, 371

[56] References Cited

U.S. PATENT DOCUMENTS

| | | | |
|---|---|---|---|
| 4,449,071 | 5/1984 | Yokoyama | 313/234 |
| 4,504,768 | 3/1985 | Ury | 315/248 |
| 4,673,846 | 6/1987 | Yoshizawa | 315/248 |
| 4,779,178 | 10/1988 | Spitz | 362/346 |
| 4,902,935 | 2/1990 | Wood | 315/248 |

*Primary Examiner*—Eugene R. LaRoche
*Assistant Examiner*—Amir Zarabian
*Attorney, Agent, or Firm*—Pollock, Vande Sande & Priddy

[57] ABSTRACT

An improved bulb mounting arrangement for an electrodeless lamp to prevent the bulb from rotating during lamp operation. The shape of the bulb mounting projection ends and the shape of the cavity side wall openings are arranged so as to cooperate with each other to preclude substantial rotation of the bulb.

14 Claims, 3 Drawing Sheets

FIG.1
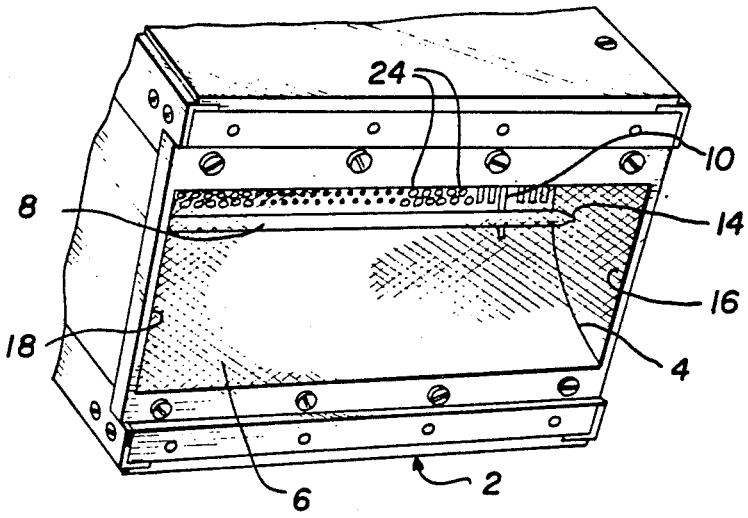
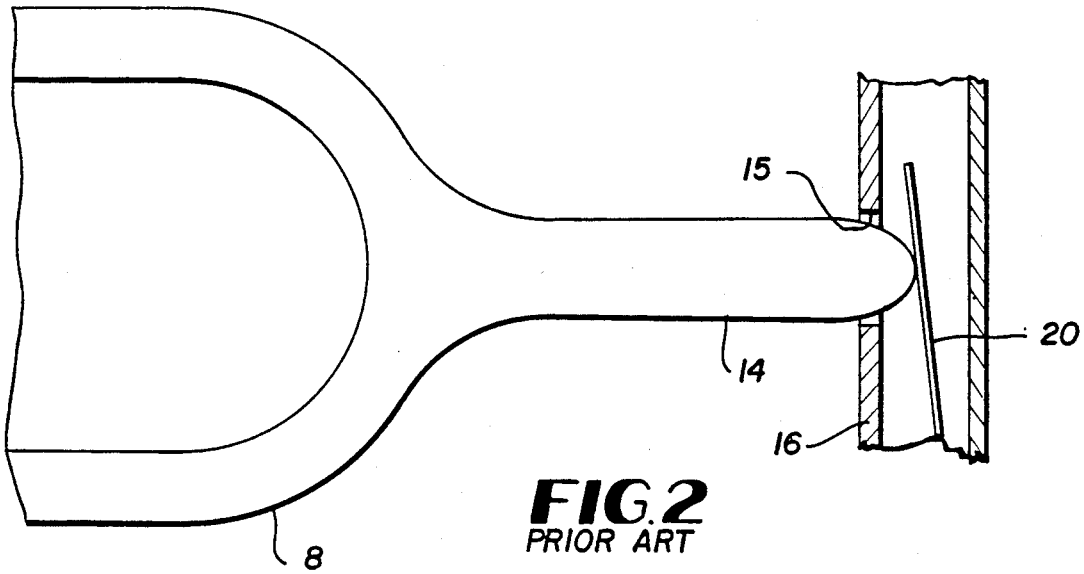
FIG.2
PRIOR ART
FIG.3
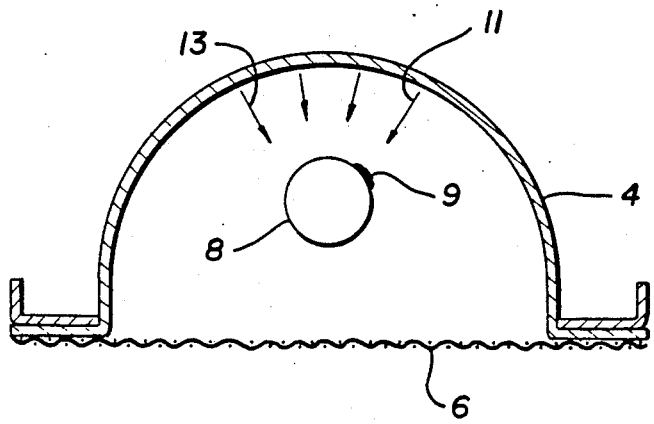

FIG.7
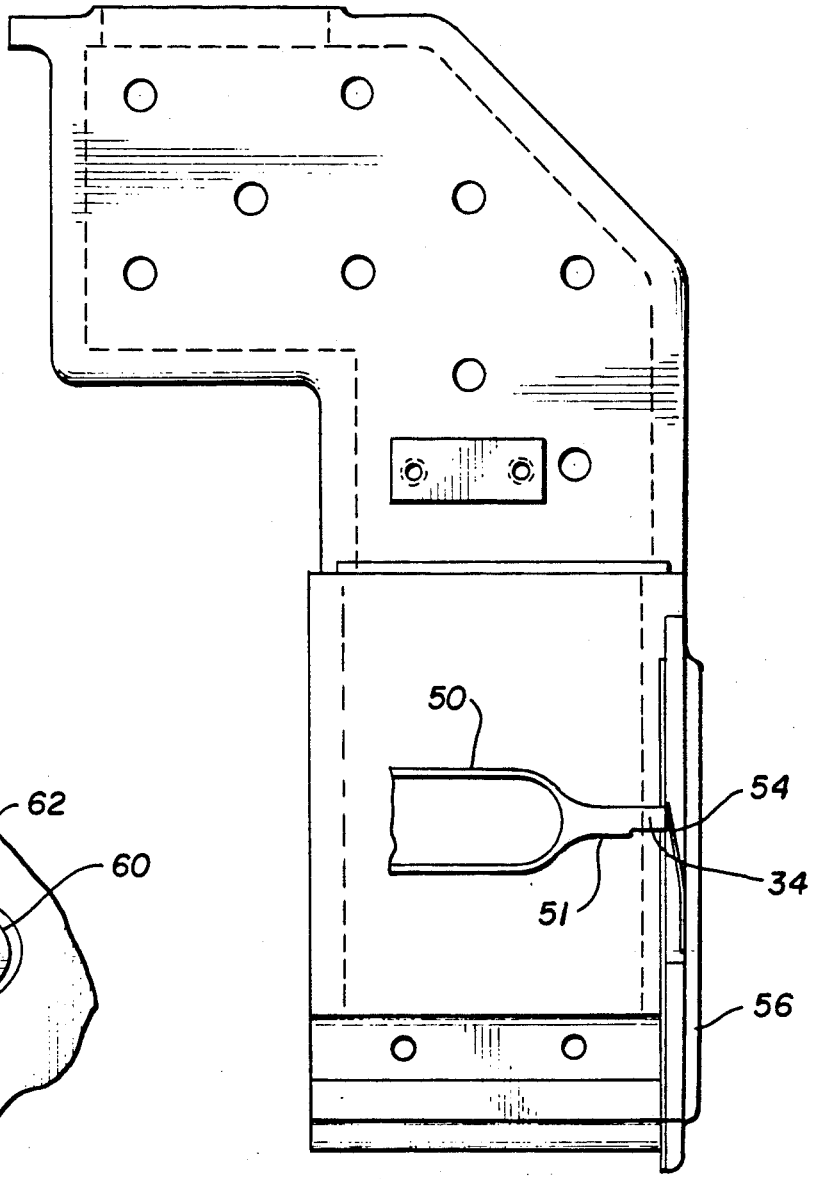
FIG.8
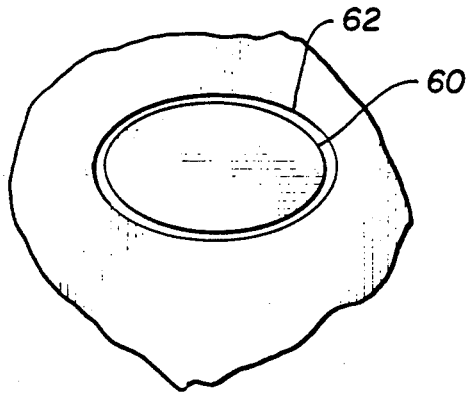
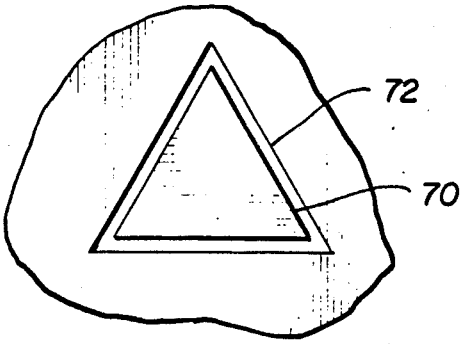
FIG.9

ELECTRODELESS LAMP WITH IMPROVED BULB MOUNTING ARRANGEMENT

The present invention is directed to an improved electrodeless lamp, and particularly to a lamp which has an improved mounting arrangement for the electrodeless lamp bulb.

An electrodeless lamp is typically comprised of a microwave cavity, at least a part of which is made of a conductive mesh material which is opaque to microwave energy, but which allows ultraviolet and visible radiation to pass out of the cavity. A lamp bulb which is filled with a plasma forming substance is mounted in the cavity, and microwave energy is fed to the cavity, wherein it is coupled to the bulb to excite a plasma therein, which emits ultraviolet or visible radiation which passes out of the lamp through the mesh.

Such lamps as described above have found widespread use for diverse applications including ultraviolet curing of inks and coatings, imaging, and semiconductor photolithography. However, one problem which has sometimes been encountered with the electrodeless lamps of the prior art is premature failure and breakage of the bulb due to overheating of certain bulb portions. In the lamps of the prior art, in which such failure has occurred, the bulb is mounted in the cavity by two tapered cylindrical projections, which are inserted in respective cylindrical holes in the side walls of the cavity, where they typically are held in place by resilient leaf spring means. During the operation of such a lamp, cooling air is blown onto the top of the electrodeless lamp bulb, with the result that dirt may accumulate at this area. When the dirt accumulates to the point where it is sufficiently heavy, it may cause the bulb to rotate so that the heaviest part of the bulb falls downwardly, that is, away from the cooling air. Since the part of the bulb on which dirt is deposited is a poorer conductor of heat than the rest of the bulb, and since this bulb portion is farthest from the source of cooling air, it may overheat, ultimately causing breakage and failure of the bulb. This problem is peculiar to electrodeless lamps because with electroded lamps, the conductors typically fix the position of the bulb.

It is thus an object of the invention to prevent bulb failure in an electrodeless lamp.

It is a further object of the invention to provide an improved mounting arrangement for an electrodeless lamp bulb.

In accordance with the invention the above objects are accomplished by providing an electrodeless lamp having a bulb which has a pair of mounting projections extending therefrom, which are inserted in openings in the side walls of the cavity, and wherein the cross-sectional shape of the projection ends and the openings are such that they cooperate with each other to preclude substantial rotation of the bulb. In a specific implementation, the aforesaid cross-sectional shape includes a straight line and an angle of about 120 degrees or less.

The invention will be better understood by referring to the accompanying drawings, wherein:

FIG. 1 and 2 show the prior art mounting arrangement.

FIG. 3 illustrates how foreign matter can accummulate on the bulb.

FIGS. 4 to 7 are illustrations of an embodiment of the present invention.

FIGS. 8 and 9 show further embodiments of the present invention.

Figure 4:
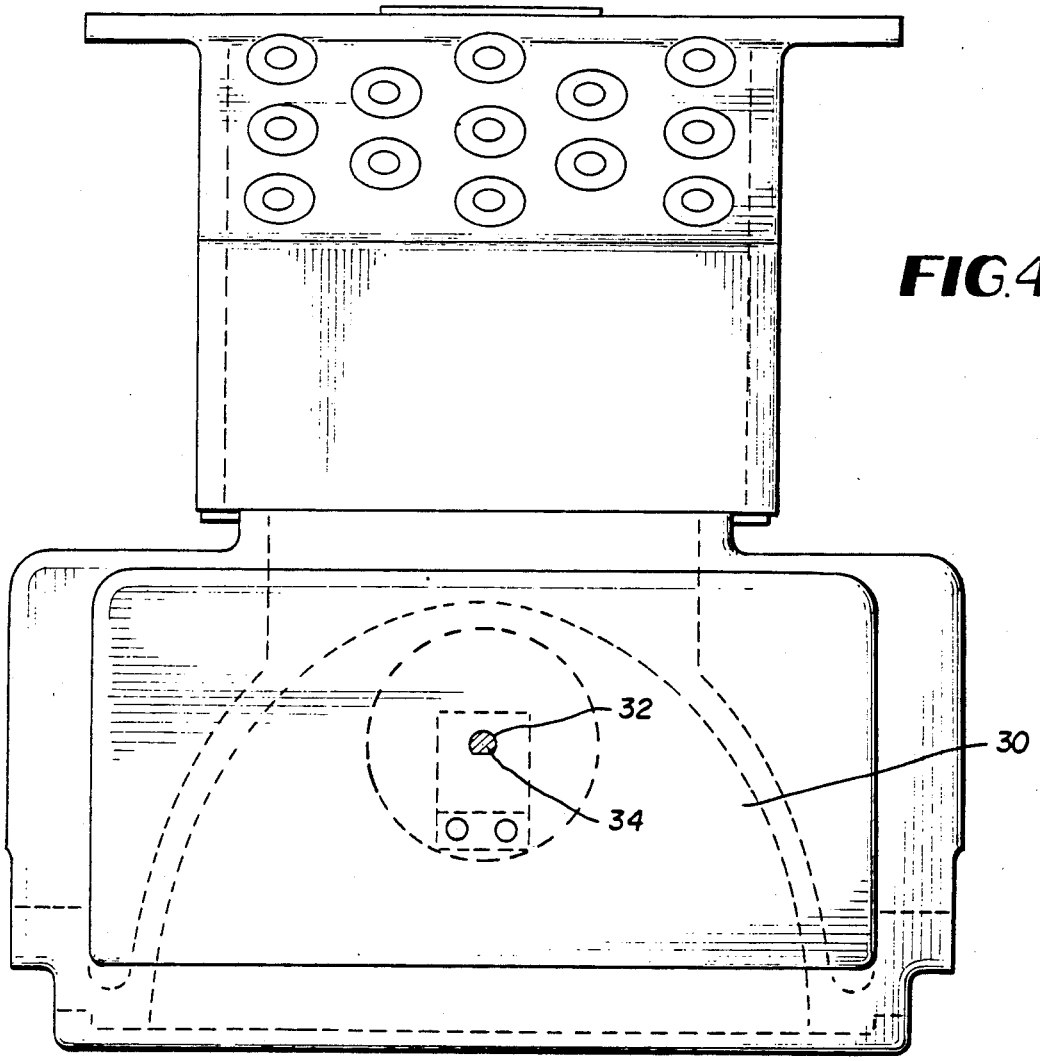

Referring to FIGS. 1 and 2, the conventional bulb mounting arrangement in accordance with the prior art is depicted. Electrodeless lamp 2 is shown, which is comprised of a microwave cavity which is made up of reflector 4 and mesh 6. Further, a bulb 8 which contains a plasma forming substance is mounted in the cavity as will be described below. Microwave energy is generated by a magnetron, and is guided to the cavity by a waveguide which couples the microwave energy to the cavity via coupling slot 10. In the particular lamp which is illustrated, there is a second coupling slot at the left end of the lamp (not shown), which is fed by another magnetron and waveguide. The microwave energy excites a plasma in the bulb 8, which emits ultraviolet and/or visible light, which exits from the cavity through mesh 6.

It is see that lamp bulb 8 has tapered cylindrical mounting projection 14 at one end thereof, and has a similar mounting projection at the other end. These mounting projections are inserted in circular holes in cavity end walls 16 and 18. This is seen more clearly by referring to FIG. 2, wherein projection 14 is inserted in hole 15, and as can further be seen resilient means such as leaf spring 20 is utilized to exert a force on the end of projection 14.

As discussed above, a problem which has been encountered with lamps of the type shown in FIGS. 1 and 2, is premature rupture of the bulbs due to overheating. Referring to FIG. 1, during operation of the lamp cooling air is forced into the cavity through cooling holes 24. This will cause foreign matter such as dirt to accumulate on the part of the bulb which is impinged by the cooling air, i.e., the top portion of the bulb when the lamp is operated with mesh 6 facing downwardly. This is seen more clearly in FIG. 3 wherein lines 11 and 13 illustrate typical paths followed by streams of cooling gas, and accumulation of foreign matter on the bulb is denoted by reference numeral 9. When the foreign matter becomes heavy enough, with the prior art mounting arrangement described above, rotation of the bulb may occur so that the heaviest part of the bulb, that is the part on which the dirt resides, faces downwardly. This part of the bulb is now furthest from the source of cooling air, and thus will tend to become hotter than the rest of the bulb. Additionally, because of the presence of the dirt, it will have a lower specific heat and tend not to conduct heat away as effectively as the rest of the bulb. Hence, this region may overheat, with the result that the bulb will prematurely break and require replacement.

An embodiment of the present invention is shown in FIGS. 4 to 7. In accordance with the invention, the lamp projection end is arranged to have a non-circular geometric cross-sectional shape, while the opening in the cavity end plate is of the same shape but slightly larger. In accordance with this arrangement, substantial rotation of the projection ends in the end openings is not possible because of the braking action between the projection end and the opening as such rotation is initiated.

Thus, referring to FIG. 4, it is seen that cavity end 30 is provided with opening 32 which is in the shape of a truncated circle, wherein the plane of truncation is such that the effective area is a little more than that covered by a semi-circle, and wherein the resultant shape includes an angle of about 120 degrees or less. Lamp projection end 34 is of a similar cross-sectional shape, and is inserted in the opening.

Figure 5:
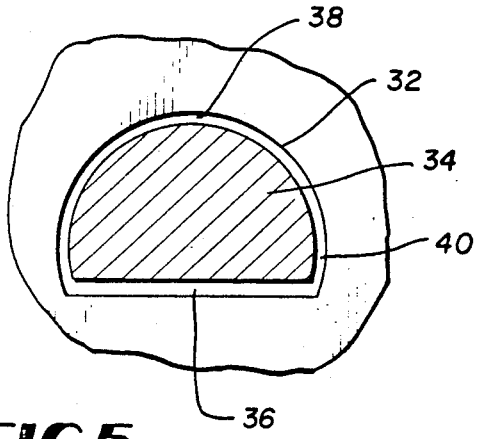

FIG. 5 is a detailed view of the projection end and opening, and depicts the relative dimensioning thereof. Thus, in an embodiment which has been built, the clearance at the bottom, denoted by the reference numeral 36 in the Figure was 0.01", while the clearance at the top and side denoted by the reference numerals 38 and 40 respectively, was 0.007", while the cross-sectional dimension of the projection end from top to bottom was 0.099."

Figure 6:
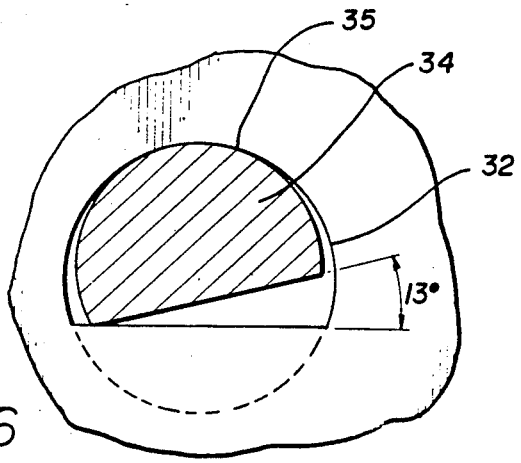

Referring to FIG. 6, it is seen that the arrangement of FIG. 5 results in a possible range of movement of the bulb of 13 degrees. This amount of movement is not substantial enough to cause a problem, and even a somewhat greater range of movement may be permissible, as dictated by the specific application.

FIG. 7 shows the bulb 50 in the interior of the cavity, and it is seen that the cross-sectional shape of projection 51, is modified at end portion 34 to correspond to that depicted in FIGS. 4 and 5. Additionally, it is seen that leaf spring 54, which is secured to support member 56, is used to exert a force on the projection end.

FIG. 8 illustrates a further embodiment of the present invention, wherein the cross-sectional shape of the projection end is bounded by a curved line and is elongated, thus resembling an ellipse in the specific implementation shown in the Figure. Projection end 60 is inserted in slightly larger opening 62, and as can be appreciated, substantial rotation of the bulb is effectively precluded.

FIG. 9 illustrates a still further embodiment of the present invention, wherein the cross-sectional shape of the projection end and associated side wall cavity opening is made up entirely of straight lines, and is a triangle in the specific implementation shown in the figure. Thus, triangular projection end 70 is inserted in slightly larger opening 72, and as can be seen, substantial rotation of the bulb is effectively precluded.

The two parameters which will affect the degree of bulb rotation are projection end/side wall opening clearance, and the geometric shape of the projection end and associated opening. A reasonable clearance is necessary for insertion and removal of the bulb. That is, the bulb is inserted and removed, by moving one end of the bulb towards the opposite end wall of the cavity to push the leaf spring on the opposite end outwardly, so as to provide clearance to allow manipulation of the one end of the bulb. Thus, there must be suitable projection end/opening clearance to allow the abovedescribed movements to be made without breaking of the bulb projection ends. It has been determined that with reasonable projection end/opening clearance, a variety of non-circular geometric shapes will be effective to preclude substantial bulb rotation and thus come within the scope of the invention. By way of non-limitative examples, one category of such geometric shapes are those which include a straight line and an angle of about 120 degrees or less, while another category of such shapes are enclosed by only a curved line, such as shown in FIG. 8. Besides preventing undesirable rotation of the bulb, the invention prevents the bulb from being inserted with the wrong orientation during cleaning.

In addition to the shape of the projection end and associated opening, a "key means" may be used to preclude rotation. For example, a key would be comprised of a member extending radially from the projection end and an associated slot in the side wall opening into which the member would fit to lock the bulb in place. Such a key arrangement could be used instead of depending on the shape of the projection end and opening to preclude rotation.

It should be appreciated that while the invention has been illustrated in connection with linear electrodeless lamps, it is not so limited, and may be employed in electrodeless lamps of any shape, so long as the bulb is supported in the cavity side walls by projection members. Further, it should be noted that while the invention has been disclosed in connection with illustrative embodiments, it is to be limited only by the claims appended hereto and equivalents.

We claim:

1. An electrodeless lamp having a removable bulb, comprising, a microwave cavity which includes spatially opposed side wall portions, at least part of said cavity comprising a mesh for transmitting radiation out of the cavity, an electrodeless lamp bulb having a pair of mounting projections extending therefrom, microwave energy generating means, means for coupling the generated microwave energy to said microwave cavity, and means at least at the ends of the lamp bulb projections and at the opposed side wall portions for cooperating with each other to secure said mounting projections to said side wall portions so that the bulb is removably mounted in the cavity in such manner it cannot substantially rotate.

2. The electrodeless lamp of claim 1 wherein said means at the side wall portions comprises openings of a predetermined geometric shape, and wherein said means at the end of each lamp projection comprises a surface having a geometric shape which is similar to said predetermined shape, but which is slightly smaller than one of said openings.

3. The electrodeless lamp of claim 2 wherein said predetermined geometric shape includes a straight line.

4. The electrodeless lamp of claim 2 wherein said predetermined geometric shape includes an angle of about 120 degrees or smaller.

5. The electrodeless lamp of claim 4 wherein said predetermined geometric shape is bounded by a curved line and is elongated.

6. The electrodeless lamp of claim 1 wherein the means at the ends of the lamp bulb projections and at the side wall portions includes key means.

7. The electrodeless lamp of claims 1, 2, 3, or 4 wherein said means at the side wall portions includes resilient means for pressing on the ends of the lamp bulb projections.

8. The electrodeless lamp of claims 1, 2, 3, or 4 wherein said microwave cavity extends in a longitudinal direction, said lamp bulb is a linear bulb, and said opposed side wall portions are at the ends of the cavity.

9. An electrodeless lamp comprising, a longitudinally extending microwave cavity which includes spatially opposed end walls, at least part of the cavity comprising a mesh for transmitting radiation out of the cavity, means for generating microwave energy, means for coupling the generated microwave energy to the cavity, a linear electrodeless lamp bulb having a pair of mounting projections extending from the ends thereof, at least the ends of the mounting projections having a predetermined cross-sectional geometric shape which includes an angle of about 120 degrees or less, said opposed end walls each having an opening therein of a shape similar to said predetermined geometric shape, but being slightly larger than the cross-sectional size of the projection ends, said projection ends being inserted in said openings, and means at each of said end walls for exerting a force on said projection ends.

10. The electrodeless lamp of claim 9 wherein said predetermined geometric shape is defined by a straight line and an arc.

11. The electrodeless lamp of claim 9 wherein said predetermined geometric shape is defined by straight lines.

12. An electrodeless lamp, comprising, a longitudinally extending microwave cavity, at least part of which comprises a mesh for transmitting radiation out of the cavity, a linear electrodeless lamp bulb having a pair of mounting projections extending from the ends thereof, at least the ends of the mounting projections having a cross-section in the shape of a predetermined truncated circle, each of said opposed end walls having an opening therein in the shape of said predetermined truncated circle, said projection ends being inserted in said openings, and means at said end walls for exerting a force on said projection ends.

13. The electrodeless lamp of claim 12 wherein said predetermined truncated circle includes an angle of about 120 degrees or less.

14. The electrodeless lamp of claim 13 wherein said means for exerting a force comprises resilient means.

* * * * *